US005188183A

United States Patent [19]

Hopmann et al.

[11] Patent Number: 5,188,183

[45] Date of Patent: Feb. 23, 1993

[54] METHOD AND APPARATUS FOR CONTROLLING THE FLOW OF WELL BORE FLUIDS

[75] Inventors: Mark Hopmann, Alvin; Steve L. Jennings; Daniel E. Dinhoble, both of Houston, all of Tex.

[73] Assignee: Baker Hughes Incorporated, Houston, Tex.

[21] Appl. No.: 695,262

[22] Filed: May 3, 1991

[51] Int. Cl.[5] ..... E21B 33/12; E21B 29/02

[52] U.S. Cl. ..... 166/387; 166/299; 166/317; 166/376

[58] Field of Search ..... 166/63, 299, 317, 373, 166/386, 387, 376

[56] References Cited

U.S. PATENT DOCUMENTS 3,095,040 6/1963 Bramlett ..... 166/317
3,357,504 12/1967 Calhoun ..... 166/63 X
3,980,134 9/1976 Amancharla ..... 166/317 X
4,220,206 9/1980 Van Winkle ..... 166/317 X
4,678,037 7/1987 Smith ..... 166/299
4,896,722 1/1990 Upchurch ..... 166/250

*Primary Examiner*—David J. Bagnell
*Attorney, Agent, or Firm*—Charles D. Gunter, Jr.

[57] ABSTRACT

An expendable plug is shown for use in a well bore tool for controlling the flow of well bore fluids from a production zone to the well surface. The plug is located within a tubular housing which is made up in a well tubing string having an internal bore with a predetermined minimum internal diameter. The plug initially closes off the internal bore of the tubing string at a selected location. An actuator is triggered by an appropriate signal to expend the plug of expendable material, and to remove the plug from the internal bore of the tubing string, whereby fluids in the surrounding earthen formation are allowed to flow up the tubing string to the well surface.

16 Claims, 4 Drawing Sheets

METHOD AND APPARATUS FOR CONTROLLING THE FLOW OF WELL BORE FLUIDS

BACKGROUND OF THE INVENTION

1. Field of the Invention

The present invention relates to well tools for selectively plugging tubing strings extending within a well bore and to hydraulically-operated well bore devices, such as well packers, to permit pressure buildup therein necessary for operating such devices, and to a method for subsequently opening such tubing strings and devices.

2. Description of the Prior Art

While drilling and producing wells for the recovery of petroleum and other subsurface deposits, it is often necessary to close off or plug a tubular conduit, such as a string of tubing extending from the well surface to a subterranean location, at a chosen point along the length of conduit so that pressure may be built up within the conduit above that point. Subsequently, it is necessary to be able to re-open the conduit for flow therethrough. For example, it may be necessary to pack-off the annulus between the tubing and a surrounding casing or well bore. This is typically done with a packer which is made up into and forms a part of the tubing string. Many such packers are set hydraulically by application of fluid pressure through the tubing. A plug apparatus is used to permit sufficient pressure to be built up within the tubing string to set the packer. Such packers are typically designed so that once set, they may be held or retained in the set condition without the continued application of fluid pressure through the tubing. Thus, the plug used to close off the tubing during setting of the packer may then be released so that fluid may be circulated through the tubing.

Flow control devices of the type under consideration also have applicability and utility in situations prior to formation perforation. For example, it may be desirable to create an underbalance adjacent the formation to be produced so that when the formation is perforated, flow is immediately initiated into the tubing, avoiding potential fouling of the newly created flow paths into the formation.

A variety of bridging and blanking plugs are shown in the prior art for plugging off the bore of a well conduit, usually the production tubing string, for various purposes. Although certain of these plugs are designed to be permanently installed, they are usually of the type which are designed to be retrieved when the purpose for which the plug has been installed has been accomplished. Retrievable plugs generally employ some form of releasable anchoring device by which the plug may be secured to the internal bore of the well pipe and which may then be released to enable the plug to be withdrawn. Typically, a seating nipple is made up in the tubing string which includes an internal profile adapted to receive locating collets, or the like, on the plug body. Typical seating nipples are shown, for example, on pages 28–36 of the Baker Oil Tools 1989 Flow Control Systems catalogue. Seating nipples of the type shown allow, for example, the location of various wireline flow control devices within the internal bore of a tubing string.

One disadvantage of the prior art arrangement was that the seating nipple presented a restriction in the internal diameter of the tubing string. Also, the prior art plugs were often retrieved on a wireline and the retrieval operation was complicated in the case of deviated well bores.

SUMMARY OF THE INVENTION

The apparatus of the invention is used to control the flow of well bore fluids from a production zone located within a subterranean formation adjacent a well bore to the well surface. The apparatus includes a tubular housing adapted to be made up in a tubing string extending from the well surface to a selected depth within the well bore. The tubing string has an internal bore with a predetermined minimum internal diameter. The tubular housing includes a plug of an expendable material which initially closes off the internal bore of the tubing string at a selected location. A well packer is preferably carried about the tubing string extending from the well surface. Actuating means, located within the tubular housing, and associated with the plug of expendable material are provided for expending the material upon receipt of a triggering signal. Control means are provided for triggering the actuating means upon receipt of a triggering signal to thereby expend the expendable material and remove the plug from the internal bore of the tubing string, whereby fluids in the surrounding earthen formation are allowed to flow up the tubing string to the well surface.

Preferably, the well packer is hydraulically settable and includes passage means such as a control line for communicating hydraulic pressure to the packer for setting the packer. Valve means provided in the tubular housing are selectively moveable between an open position where flow is possible through the tubing string and through the control line to the packer to set the packer and a closed position where flow is prevented. A restraining means can be provided to initially hold the valve means in the closed position.

A potential energy means is preferably provided as a part of the actuating means for storing potential energy. The control means selectively releases the potential energy means upon receipt of a first triggering signal to convert the stored potential energy into kinetic energy, whereupon the kinetic energy over powers the restraining means to move the valve means to the open position and allow the packer to be set. The actuating means is also preferably responsive to a second and distinct triggering signal from the control means for expending the expendable material of the plug. This sequence of steps removes the plug from the internal bore of the tubing string and fluids in the surrounding earthen formation are allowed to flow up the tubing string to the well surface.

The actuating means which is associated with the plug of expendable material and which is responsive to the second and distinct triggering signal from the control means can be provided as a ceramic disc having an explosive cord formed therein for expending the expendable material upon receipt of the second and distinct triggering signal.

In the method for controlling the flow of well bore fluids of the invention, a well tool is made up including a plug in a tubing string having an internal bore with a predetermined minimum internal diameter, the tubing string also carrying an external well packer. The internal bore of the tubing string is initially closed off by the plug at a selected location. The tool is run on the tubing string to a selected depth within the well bore and the well packer is set to isolate a production interval of the well bore. Actuating means are provided which are associated with the plug for dislocating the plug upon receipt of a triggering signal. The actuating means is triggered by transmitting a triggering signal to thereby dislocate the plug from the internal bore of the tubing string and allow the dislocated plug to flow to the well surface as fluids in the surrounding earthen formation are allowed to flow up the tubing string to the well surface.

Preferably, the plug is formed from an expendable material. Since the plug is expended upon receipt of the triggering signal, the predetermined minimum internal diameter of the tubing string is maintained both before and after expending the plug.

If it is desirable to create an underbalanced condition in the tubing, the well tool can be run into position within the well bore with the internal bore of the tubing string being initially closed off by the plug. Thereafter, hydrostatic forces in the tubing string above the well tool can be removed and the plug can then be expended to allow the well bore fluids to flow up the tubing string to the well surface.

Valve means, provided as a part of the well tool, are moveable between an open position where flow is possible through the tubing string to the packer to set the packer and a closed position where flow is prevented. By initially restraining the valve means in the closed position while running into the well bore, it is possible to test the tubing string for leaks without fear of prematurely setting the packer. This can be accomplished by pressuring the internal bore of the tubing string with pressurized fluid pumped down the internal bore of the tubing string from the well surface.

Additional objects, features and advantages will be apparent in the written description which follows.

FIGS. *3a* and *3b* are a side, quarter-sectional view of the well tool of the invention showing the expendable plug which initially closes off the internal bore of the tubing string; and FIGS. *4a* and *4b* are simplified, isolated views of alternate arrangements of a pair of strain gages which are used to detect changes in axial and/or circumferential stresses in the tubing string in order to trigger the actuating means of the invention.

DETAILED DESCRIPTION OF THE INVENTION

Figure 1:
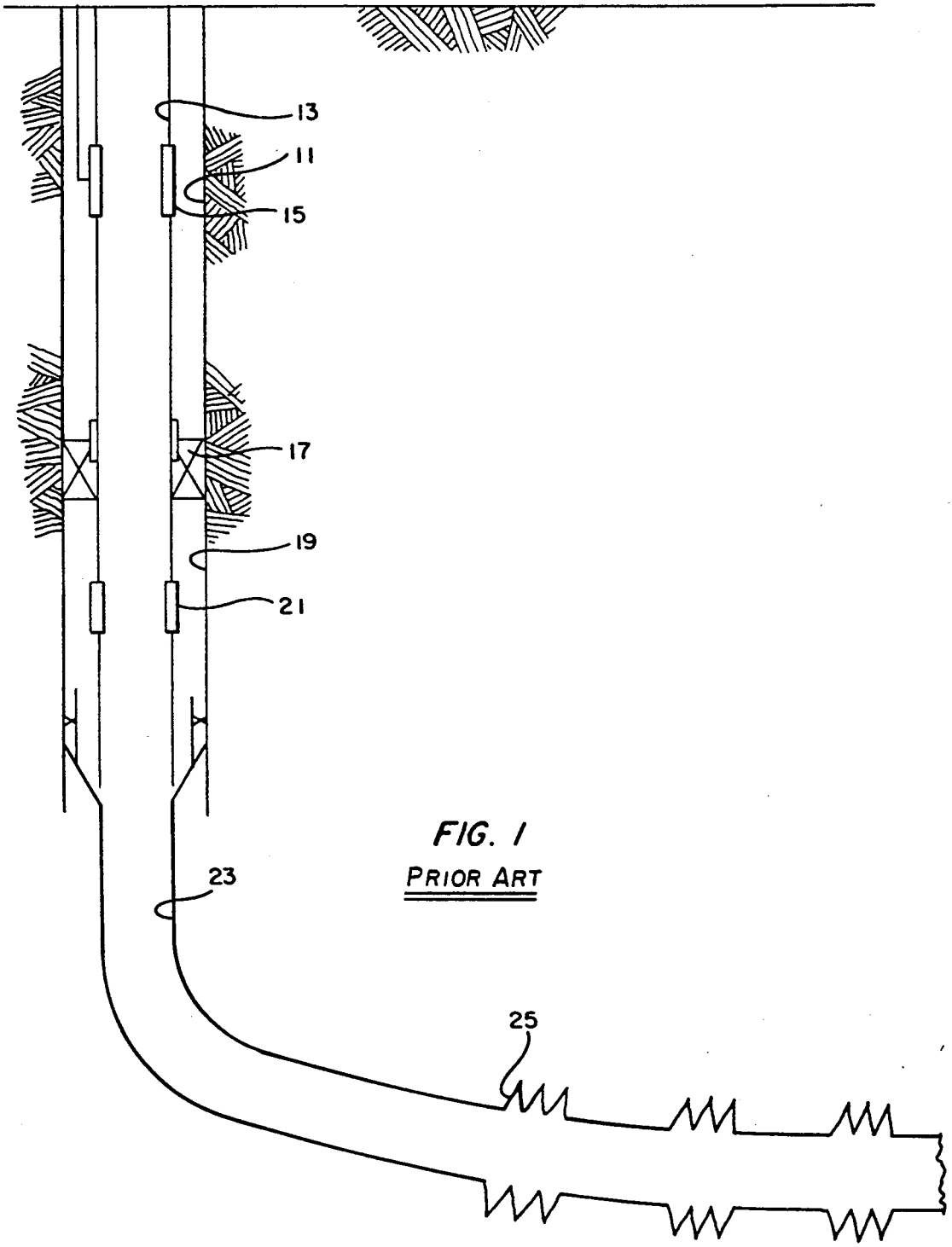
FIG. 1 PRIOR ART
FIG. 1 is a simplified, schematic view of a well bore completion showing the prior art landing nipple which was used to receive a retrievable wireline plug and which presented a restriction in the internal diameter of the tubing string.

FIG. 1 shows a prior art well completion in which a well bore 11 is lined with a 9⅝ inch well casing having an internal diameter of approximately 8.535 inches. A 7 inch casing, designated as 13, and having an internal diameter of approximately 6.059 inches is located within the cased well bore and includes a conventional safety valve nipple 15 with an approximate internal diameter of 5.875 inches. A commercially available Baker "SAB" packer 17 isolates an annular region 19 located below the packer 17 between the casing 13 and the well bore 11.

A landing nipple 21 forms an internal profile within the bore of the casing 13 below the packer 17, thereby reducing the internal diameter to approximately 5.625 inches. The completion also includes a production casing 23 which depends from the outer casing and which follows a deviated bore, as illustrated in FIG. 1 to a producing interval indicated by the perforations 25. The internal diameter of the production casing adjacent the perforations is approximately 6.059 inches.

Figure 2:
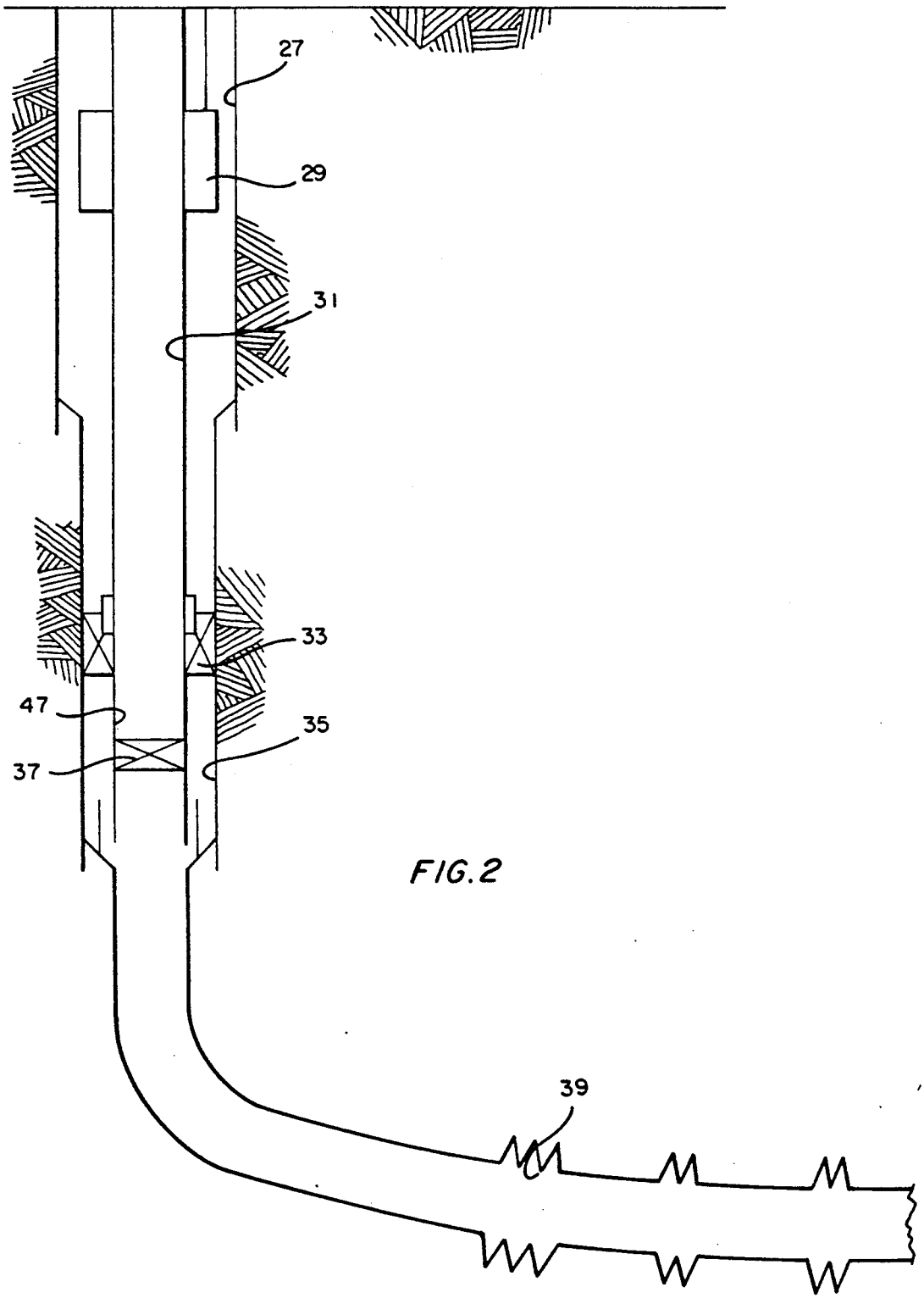
FIG. 2 is a simplified, schematic view similar to FIG. 1 which shows the proposed completion apparatus and method of the invention.

FIG. 2 illustrates the proposed completion of the invention in which a well bore 27 is lined with a 10¾ inch casing. A commercially available Baker "FVLS" tubing mounted valve 29 is located within a string of 7 inch casing 31 which has an approximate internal diameter of 6.059 inches. A Baker commercially available "SAB" packer 33 isolates an annular region 35 located below the packer 33 between the casing 31 and the well bore 27. An expendable plug 37 of the invention initially closes off flow from the perforated zone 39 up the internal bore of the casing 31 to the well surface. The expendable plug 37 forms a portion of a well tool having an approximate internal diameter of 6.00 inches which is approximately equal to the minimum internal diameter of the string of pipe forming the flow path to the well surface. For purposes of the present invention, the terms conduit, pipe, casing and tubing will all be used interchangeably.

FIG. *3a* shows the preferred expendable plug of the invention, designated generally as 41. The plug 41 includes a tubular housing 43 having a threaded upper extent 45 which is adapted to be made up in the string of well tubing (47 in FIG. 2) extending to the well surface and having a lower threaded extent 49 which is similarly made up in the downwardly depending string of tubing.

The tubing string 47 has a predetermined minimum internal diameter, in this case approximately 6 inches. The internal diameter of the internal bore 53 of the tubular housing is also approximately 6 inches. The tubular housing 43 includes a plug 51 of an expendable material which initially closes off the internal bore 53 of the tubing string at a selected location, as will be described more fully.

A hydraulically settable well packer (33 in FIG. 2) is carried about the tubing string extending from the well surface above the well tool 41 and includes passage means such as a control line which communicates with the control line 55 of the well tool 41 for communicating hydraulic pressure to the packer for setting the packer. Packers are a well-known conventional devices featuring resilient elements which can be selectively expanded and contracted to contact either a well bore or casing to seal off an annular area. A typical example is the Baker "SAB" hydro-set production packer illustrated at page 516 of the Baker Packer 1984–1985 Catalog and commercially available from Baker Hughes Incorporated.

Valve means are provided within the tubular housing 43 which are selectively moveable between the closed position shown in the FIG. *3a* and an open position where flow is possible through the tubing string and through the control line 55 to the packer to set the packer 33 and a closed position where flow is prevented.

Figure 3A:
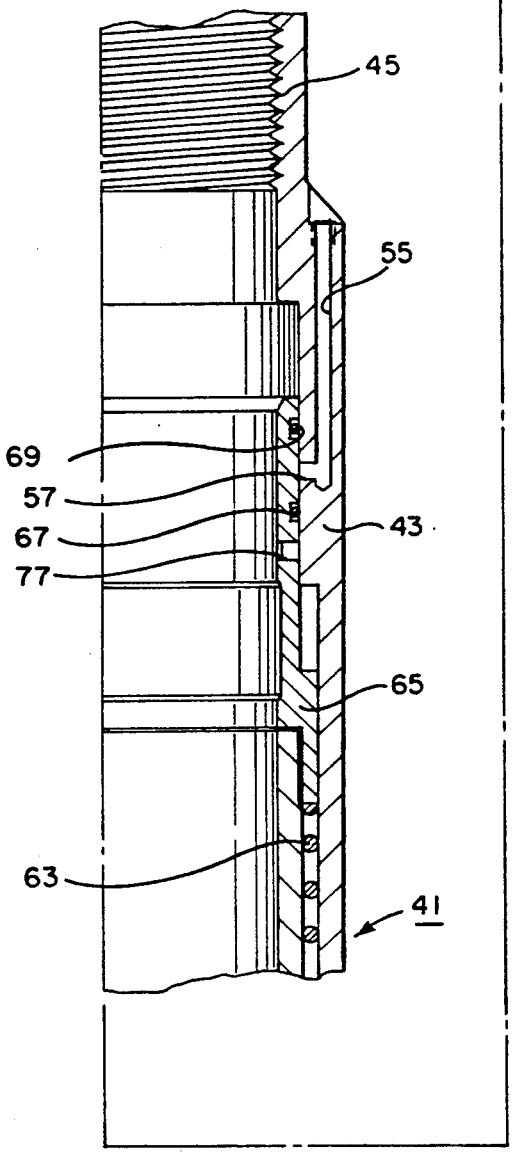

In the embodiment of FIG. *3a*, the tubular housing includes a port 57 which communicates the tubing string internal bore 53 with the control line 55 to the packer 33. The valve means further comprises a generally elongated piston member 59 having a first extent 61 which defines a spring bearing surface for retaining a coil spring 63 which acts on the elongate piston member to urge the valve means toward the open position. The elongate member has a second extent 65 which includes a sealing surface such as the spaced O-rings 67, 69 shown in FIG. 3*a*. The sealing surface serves to close the port 57 provided in the tubular housing to the control line 55 of the packer when the valve means is in the closed position shown in FIG. 3*a*.

Figure 3B:
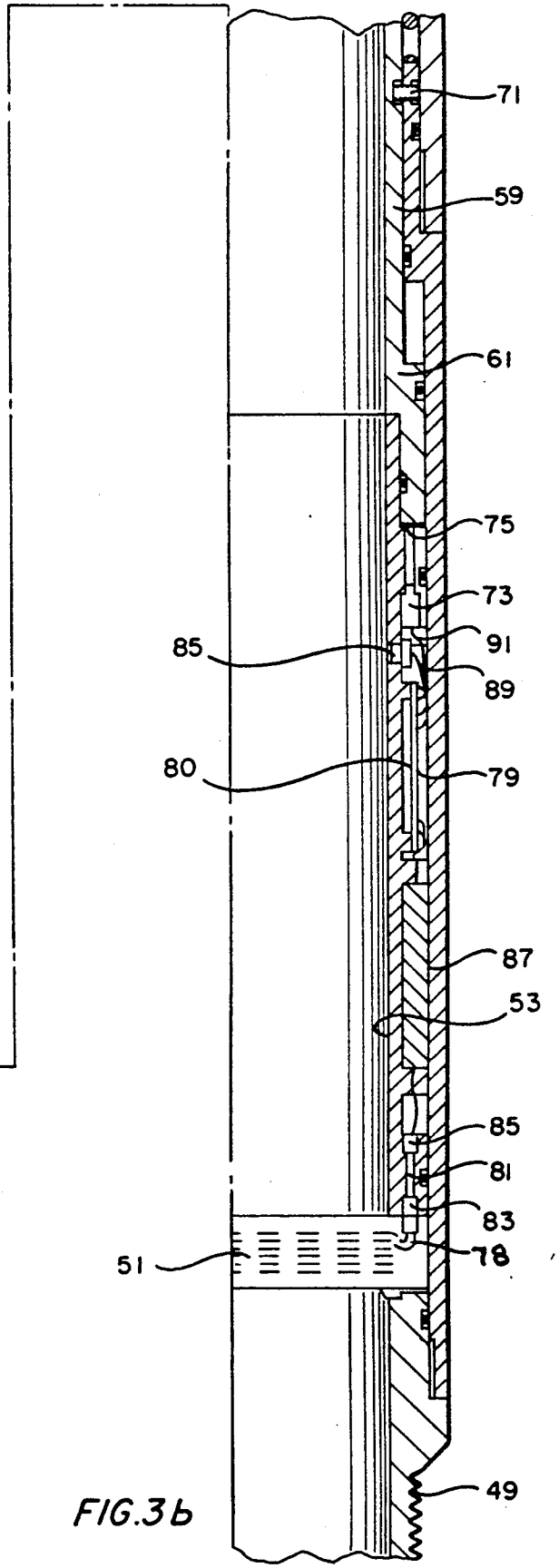

Restraining means, such as shear pins 71 are provided for initially holding the valve means in the closed position shown in FIG. 3*b*.

In the embodiment of the tool illustrated in FIG. 3*b*, a potential energy means is provided for storing potential energy on the tool. Preferably, the potential energy means is a pyrotechnic cartridge 73 which, when triggered generates gas pressure which acts on the exterior face 75 of the piston member 59 to force movement of the elongated piston member and sever the shear pins 71. Movement of the elongated piston member moves the valve means to the open position whereby aperture 77 of the valve means is aligned with the port 57 to allow communication of fluid within the internal bore of the tubing string through the control line 55 to set the packer.

A control means is preferably provided for selectively releasing the potential energy means upon receipt of a first triggering signal to convert the stored potential energy into kinetic energy, where upon the kinetic energy over powers the restraining means 71 to move the valve means 59 to the open position and allow the packer to be set. The control means can take a variety of forms including a conventional timer or a signal sensing and processing unit.

The control means 79 preferably includes a signal generating means forming a part of the wall of the tubing string leading to the well surface for selectively generating a signal in response to a predetermined condition detectable on the wall of the tubing string. In the embodiment of FIG. 3*b*, the signal generating means includes a pressure transducer 85 which serves to generate a signal to the control means 79 based upon the detected pressure of fluids within the internal bore 53 of the tubing string.

U.S. Pat. No. 4,896,722, issued Jan. 30, 1990, the disclosure of which is incorporated herein by reference shows one such control means in which pressure pulses applied to the fluid standing in the well annulus are sensed by a downhole pressure transducer. A predetermined pattern of sensed pulses constitutes a kickoff stimulus for beginning execution of stored microcode in a downhole microprocessor. Execution of the microcode serves to actuate the downhole tool operations.

Figure 4A:
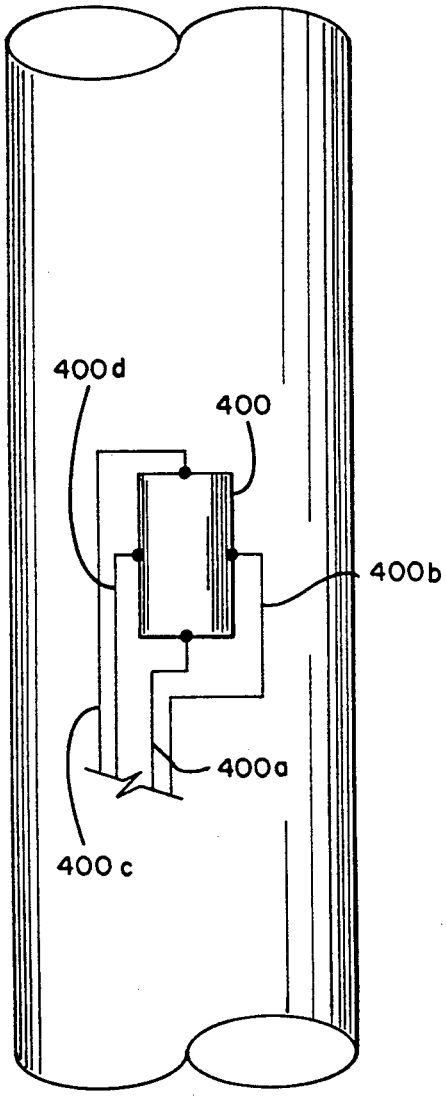
Figure 4B:
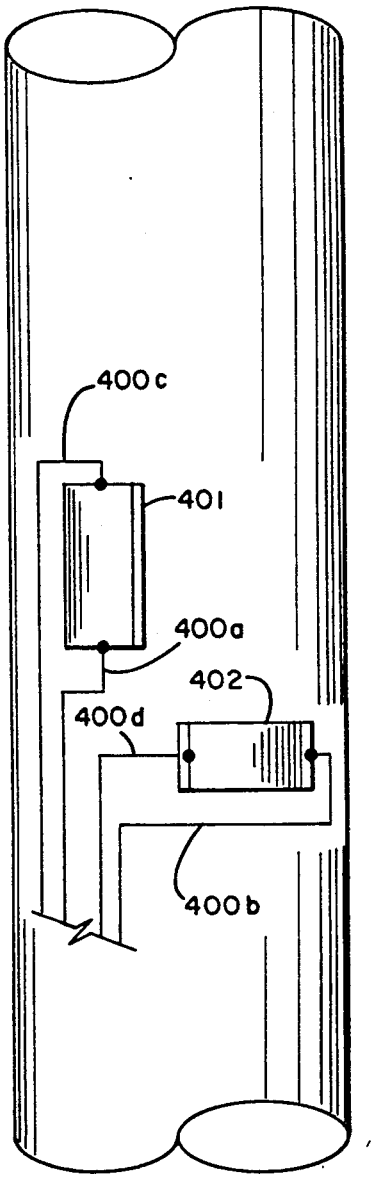

Other downhole signal generating means can be utilized with the well tool of the invention, such as the signal generating means described in the co-pending application, Ser. No. 549,803, entitled Subsurface Well Apparatus, filed Jul. 9, 1990, and assigned to the assignee of the present invention, the disclosure of which is hereby incorporated herein by reference. In that signal generating means, a strain gage (FIGS. 4*a* and 4*b*) is applied to the wall of the tubing string which will change its resistance in response to significant changes in the stresses existing in the conduit wall to which it is attached. The strain gage (400 in FIG. 4*a*) is shown as having connectors 400*a*, 400*b*, 400*c* and 400*d* respectively connected to the midpoints of each side of the strain gage 400. Thus, the connectors 400*a* and 400*c* will detect changes in resistance due to changes in axial stress in the conduit. Connectors 400*b* and 400*d* will detect changes in resistance due to changes in circumferential stress in the conduit. Connectors 400*a*, 400*b*, 400*c* and 400*d* thus provide signal inputs to a microprocessor (board 80 in FIG. 3) which will generate an activating voltage for operating the downhole tool. Another arrangement of strain gages 401, 402 is shown in FIG. 4*b*. The first strain gage 401 has connectors 400*a*, 400*c* to indicate axial stresses. The second strain gage 402 is circumferentially secured to the conduit and has connectors 400*b* and 400*d* secured to its opposite ends to indicate circumferential stresses in the conduit.

The microprocessor 80 included as a part of the control means 79 is pre-programmed to detect a predetermined sequence of strain which is detected by the strain gage. A battery pack 87 delivers electrical energy through the leads 89 to the microprocessor and, through the microprocessor, to the pyrotechnic cartridge 73. As the strain gage detects the stresses defined through the tubing string, a signal is sent through leads 91, which actuates the pyrotechnic charge 73. As the charge 73 is ignited, gas pressure builds up against the exterior face 75 of the piston member 59, shearing the screw 71 and moving the valve means from the closed position shown in FIG. 3*a* to the open position.

Actuating means are also provided which are associated with the plug of expendable material 51 and which are responsive to a second and distinct triggering signal from the control means for expending the expendable material upon receipt of the second and distinct triggering signal.

In the embodiment of FIG. 3*b*, the expendable plug 51 is a solid, ceramic disc which is molded about an explosive cord 78 for expending the expendable material upon receipt of the second and distinct triggering signal whereby the plug is removed from the internal bore of the tubing string and fluids in the surrounding earthen formation are allowed to flow up the tubing string to the well surface. The explosive cord 78 can be, for example a "PRIMACORD" of the type used in perforating guns and commercially available from Baker Service Tools of Houston, Tex. The explosive cord 78 is placed in communication with the control means 79 by means of a suitable lead line 81 and plugs 83, 85.

The second and distinct signal is thus detected and processed by the control means 79 to cause current to flow through the leads 81 to the explosive cord 78 to expend the plug 51.

Although the expendable plug 51 is shown as a ceramic disc containing an explosive means, it could also be an expendable member which is flowed up or down the internal bore of the tubing string, which is imploded or which is attacked by means of a chemical agent or by chemical reaction.

In the method of the invention, a well tool is made up including a plug and run on a tubing string to a selected depth within the well bore. The well packer 33 is then set to isolate a production interval of the well bore. Actuating means, associated with the plug 51, are then actuated to dislocate the plug upon receipt of a triggering signal transmitted from the well surface. Dislocating the plug 51 allows the dislocated plug to flow to the well surface as fluids in the surrounding earthen formation are allowed to flow up the tubing string to the well surface.

In the preferred method, the plug is formed of an expendable material and the actuating means associated with the plug serve to expend the material upon receipt of a triggering signal transmitted from the well surface. Since the plug is expended during the actuating step, the predetermined minimum internal diameter of the tubing string is maintained both before and after expending the plug of expendable material.

Because the control line used to set the hydraulic packer is initially closed off by the valve means of the device, the tubing string above the well tool can be tested for leaks by pressurizing the internal bore of the tubing string with the pressurized fluid pumped down the internal bore of the tubing string from the well surface.

The expendable plug also allows the well tool to be run into position within the well bore where the internal bore of the tubing string being initially closed off by the plug. Hydrostatic forces in the tubing string above the well tool can then be removed and, thereafter, the plug can be expended to allow well bore fluids to enter the underbalanced tubing string and flow up the tubing string to the well surface.

An invention has been provided with several advantages. The expendable plug of the invention can be provided as a part of a well tool which maintains a predetermined minimum internal diameter of an associated tubing string without constituting a restriction in the tubing string. The expendable plug can be provided in a variety of forms including exploded members, imploded members, members attacked by chemical reaction and members which are flowed up or flowed down the tubing string. The device of the invention allows the operator to test the integrity of the tubing string during running in operations without fear of setting the hydraulic packer prematurely. The expendable plug also allows the operator to create an underbalanced situation above the well tool to facilitate flow of well bore fluids prior to expending the plug.

While the invention has been shown in only one of its forms, it is not thus limited but is susceptible to various changes and modifications without departing from the spirit thereof.

What is claimed is:

1. A method for controlling the flow of well bore fluids from a production zone located within a subterranean formation adjacent a well bore to the well surface, the method comprising the steps of:

making up a well tool including a plug in a tubing string having an internal bore with a predetermined minimum internal diameter, the internal bore of the tubing string being initially closed off by the plug at a selected location, the well tool which is made up within the tubing string also carrying an external well packer;

running the well tool on the tubing string to a selected depth within the well bore;

setting the well packer in the well bore to isolate a production interval of the well bore;

providing actuating means associated with the plug for dislocating the plug upon receipt of a triggering signal transmitted from the well surface; and triggering the actuating means by transmitting a triggering signal from the well surface to thereby dislocate the plug from the internal bore of the tubing string and allow the dislocated plug to flow to the well surface as fluids in the surrounding earthen formation are allowed to flow up the tubing string to the well surface.

2. A method for controlling the flow of well bore fluids from a production zone located within a subterranean formation adjacent a well bore to the well surface, the method comprising the steps of:

making up a well tool including a plug of an expendable material in a tubing string having an internal bore with a predetermined minimum internal diameter, the internal bore of the tubing string being initially closed off by the plug at a selected location, the well tool which is made up within the tubing string also carrying an external well packer;

running the well tool on the tubing string to a selected depth within the well bore;

setting the well packer in the well bore to isolate a production interval of the well bore;

providing actuating means associated with the plug of expendable material for expending the material upon receipt of a triggering signal transmitted from the well surface; and triggering the actuating means by transmitting a triggering signal from the well surface to thereby expend expendable material and remove the plug from the internal bore of the tubing string, whereby fluids in the surrounding earthen formation are allowed to flow up the tubing string to the well surface.

3. The method of claim 2, wherein the predetermined minimum internal diameter of the tubing string is maintained both before and after expending the plug of expendable material.

4. The method of claim 3, further comprising the steps of:

storing energy in the well tool as it is run into the well bore;

selectively releasing a first quantity of stored energy as the actuating means is triggered to set the well packer;

thereafter releasing a second quantity of stored energy to expend the plug of expendable material.

5. The method of claim 4, wherein the well tool is run into position within the well bore with the internal bore of the tubing string being initially closed off by the plug, thereafter removing hydrostatic forces in the tubing string above the well tool and, thereafter, expending the plug of expendable material and allowing the well bore fluids to flow up the tubing string to the well surface.

6. A method for controlling the flow of well bore fluids from a production zone located within a subterranean formation adjacent a well bore to the well surface, the method comprising the steps of:

making up a well tool including a plug of an expendable material in a tubing string having a predetermined minimum internal bore, the internal bore of the tubing string being initially closed off by the plug at a selected location, the well tool which is made up within the tubing string also carrying an external well packer;

running the well tool on the tubing string to a selected depth within the well bore;

testing the tubing string for leaks by pressuring the internal bore of the tubing string with pressurized fluid pumped down the internal bore of the tubing string from the well surface;

setting the well packer in the well bore to isolate an annular region of the well bore located between the exterior of the pipe string and the surrounding well bore;

providing actuating means associated with the plug of expendable material for expending the material upon receipt of a triggering signal transmitted from the well surface; and triggering the actuating means by transmitting a triggering signal from the well surface to thereby expend expendable material and remove the plug from the internal bore of the tubing string, whereby fluids in the surrounding earthen formation are allowed to flow up the tubing string to the well surface.

7. An apparatus for controlling the flow of well bore fluids from a production zone located within a subterranean formation adjacent a well bore to the well surface, comprising:

a tubular housing adapted to be made up in a tubing string extending from the well surface to a selected depth within the well bore, the tubing string having an internal bore with a predetermined minimum internal diameter, the tubular housing including a plug of an expendable material which initially closes off the internal bore of the tubing string at a selected location;

a well packer carried about the tubing string extending from the well surface;

actuating means located within the tubular housing and associated with the plug of expendable material for expending the material upon receipt of a triggering signal; and control means for triggering the actuating means upon receipt of a triggering signal from the well surface to thereby expend the expendable material and remove the plug from the internal bore of the tubing string, whereby fluids in the surrounding earthen formation are allowed to flow up the tubing string to the well surface.

8. An apparatus for controlling the flow of well bore fluids from a production zone located within a subterranean formation adjacent a well bore to the well surface, comprising:

a tubular housing adapted to be made up in a tubing string extending from the well surface to a selected depth within the well bore, the tubing string having an internal bore with a predetermined minimum internal diameter, the tubular housing including a plug of an expendable material which initially closes off the internal bore of the tubing string at a selected location;

a hydraulically settable well packer carried about the tubing string extending from the well surface, the well packer including a control line for communicating hydraulic pressure to the packer for setting the packer;

valve means in the housing selectively movable between an open position where flow is possible through the tubing string and through the control line to the packer to set the packer and a closed position where flow is prevented;

restraining means on the valve means to initially hold the valve means in the closed position;

potential energy means for storing potential energy;

control means for selectively releasing the potential energy means upon receipt of a first triggering signal transmitted from the well surface to convert the stored potential energy into kinetic energy, whereupon the kinetic energy overpowers the restraining means to move the valve means to the open position and allow the packer to be set;

actuating means associated with the plug of expendable material and responsive to a second and distinct triggering signal from the control means for expending the expendable material upon receipt of the second and distinct triggering signal transmitted from the well surface, whereby the plug is removed from the internal bore of the tubing string and fluids in the surrounding earthen formation are allowed to flow up the tubing string to the well surface.

9. The apparatus of claim 8, wherein the control means includes a piston mounted for movement in the tubular housing and wherein the potential energy means, when triggered by the control means, serves to move the piston, which in turn results in movement of the valve means.

10. The apparatus of claim 9, wherein the restraining means is a shear screw which is sheared by the action of the potential energy means when triggered by the control means.

11. The apparatus of claim 10, wherein the tubular housing includes a port which communicates the tubing string interior with the control line to the packer, and wherein the valve means further comprises a generally elongated piston member having a first extent which defines a spring-bearing surface for retaining a coil spring which acts on the elongate piston member to urge the valve means toward the open position, the elongate member having a second extent which includes a sealing surface, the sealing surface serving to close the port to the control line of the packer when the valve means is in the closed position.

12. The apparatus of claim 11, wherein the potential energy means is a pyrotechnic cartridge which, when triggered by the control means, generates pressure which acts on the elongated piston member to force movement of the elongated piston member to move the valve means to the open position and allow communication of fluids through the control line to set the packer.

13. The apparatus of claim 12, wherein said actuating means associated with the plug of expendable material and responsive to a second and distinct triggering signal from the control means is a ceramic disc having an explosive cord formed therein for expending the expendable material upon receipt of the second and distinct triggering signal transmitted from the well surface, whereby the plug is removed from the internal bore of the tubing string and fluids in the surrounding earthen formation are allowed to flow up the tubing string to the well surface.

14. The apparatus of claim 13, wherein the control means includes a signal generating means forming a part of the wall of the tubing string leading to the well surface for selectively generating a signal in response to a predetermined condition detectable on the wall of the tubing string.

15. The apparatus of claim 14, wherein the signal generating means includes a strain gage for generating a signal proportional to the strain in a wall portion of the tubing string.

16. The apparatus of claim 14, wherein the signal generating means includes a pressure transducer for generating a signal responsive to pressure differences detected between the annulus fluid pressure and the pressure of fluids within the internal bore of the tubing string.

* * * * *